US005398410A

United States Patent [19]

Yasui et al.

[11] Patent Number: 5,398,410

[45] Date of Patent: Mar. 21, 1995

[54] METHOD OF MAKING A SUPERPLASTICALLY FORMED STRUCTURE HAVING A PERFORATED SKIN

[75] Inventors: Ken K. Yasui, Huntington Beach; Kenneth H. Rogers, Corona, both of Calif.

[73] Assignee: McDonnell Douglas Corporation, Huntington Beach, Calif.

[21] Appl. No.: 34,874

[22] Filed: Mar. 19, 1993

[51] Int. Cl.[6] ..... B23P 15/00

[52] U.S. Cl. ..... 29/847.2; 29/421.1; 29/424; 228/157

[58] Field of Search ..... 29/897.2, 423, 424, 29/421.1, 454; 228/157, 193, 182

[56] References Cited

U.S. PATENT DOCUMENTS

| | | | |
|---|---|---|---|
| 3,373,480 | 3/1968 | Fuchs, Sr. | 228/157 |
| 4,333,216 | 6/1982 | Slaughter | 29/423 |
| 4,534,503 | 8/1985 | Stephen et al. | 228/157 |
| 4,604,780 | 8/1986 | Metcalfe | 29/423 |
| 4,807,342 | 2/1989 | Lapeyre | 29/423 |
| 4,901,552 | 2/1990 | Ginty et al. | 29/421.1 |
| 5,024,369 | 6/1991 | Froes et al. | 228/157 |
| 5,204,161 | 4/1993 | Pettit et al. | 228/157 |
| 5,226,578 | 7/1993 | Douglas | 228/157 |
| 5,289,965 | 3/1994 | Yasui et al. | 228/157 |
| 5,300,367 | 5/1994 | Bodart et al. | 228/157 |

*Primary Examiner*—Irene Cuda

*Attorney, Agent, or Firm*—James M. Skorich; John P. Scholl

[57] ABSTRACT

A perforated sheet is diffusion bonded to a thin solid sheet. Each of the perforations of the perforated sheet is tapered, having a maximum diameter at the surface that is not bonded to the thin sheet and a smaller diameter at the surface that is bonded to the thin sheet. The bonded perforated sheet and thin sheet are included with other solid metallic sheets in a forming pack to be superplastically deformed into a structure. The bonded perforated sheet and thin sheet are placed on the top of the forming pack so that the thin sheet will face outwards after the structure is formed. After the superplastic deformation process is completed, the thin sheet is removed by machining to expose the perforated sheet and provide a structure for controlling laminar flow over the perforated sheet. The exposed surface of the perforated sheet includes the smaller diameter of each tapered perforation, while the inner-facing or blind surface of the sheet includes the maximum diameter. The formed structure includes internal passageways. The perforated sheet fluidly communicates the ambient atmosphere with the passageways. Control of laminar flow over the exposed surface of the perforated sheet is obtained by controlling the pressure in the passageways.

2 Claims, 3 Drawing Sheets

METHOD OF MAKING A SUPERPLASTICALLY FORMED STRUCTURE HAVING A PERFORATED SKIN

BACKGROUND OF THE INVENTION

1. Field of the Invention

The invention relates to superplastically formed structures and, more particularly, to including a perforated sheet in a forming pack to be superplastically deformed into a structure for controlling laminar flow over an airplane.

2. Description of the Prior Art

The salutary aerodynamic characteristics of laminar flow have been obtained over aircraft surfaces where the flow would otherwise have become turbulent, by applying suction through a perforated aircraft skin. For optimal effect, aircraft require skin perforations that are extraordinarily small. For example, for a skin thickness of 0.040 of an inch, the perforations usually will have a diameter of less than 0.004 of an inch at the outer-facing surface of the skin, that is, the skin surface that is exposed to fluid flow.

It has also been found that the perforations are subject to clogging by airborne particles when the perforation has a tapered shape wherein its diameter at the exposed surface is larger than its diameter at the inner-facing or blind surface. The preferred shape is a taper wherein the diameter of the perforation at the blind surface is larger than its diameter at the exposed surface.

An electron beam or laser beam can drill perforations of the desired small diameter in skins composed of titanium alloys, the metals required by high speed airplanes because such alloys retain their strength at elevated temperatures. The perforations can be drilled through the skin either before the skin is incorporated into the aircraft structure, or after the structure has been manufactured. However, there are problems associated with each alternative.

Where the perforations are to be drilled through a skin that is already incorporated into the airplane structure, the electron or laser beam can drill perforations having a sufficiently small diameter at the exposed surface. However, the diameter of this perforation decreases as the depth of the perforation increases, such that the diameter of the perforation at the exposed surface is greater than the diameter at the blind surface. As previously noted, a perforation of this shape is susceptible to clogging.

An electron or laser beam can drill perforations having a diameter larger at the blind surface than at the exposed surface. The attendant problem is that such perforations have an outer surface diameter greater than the small diameter typically required for effective laminar flow control.

Further, when the perforations are made on a skin already attached to the aircraft structure, dust particles are created by the drilling process and fall into the structure. As the particles are extremely hot when they are formed, they oftimes adhere to the blind surface and are thus not easily removed because of the inaccessibility of the blind surface. Rather, the particles come loose when subjected to the vibration caused by flight, and can subsequently clog the perforations when the perforations are periodically subjected to reverse flow to clear them, or when hot air is forced through the perforations to de-ice the exposed surface of the skin.

In order to avoid the foregoing drawbacks, skins have been perforated to the required size and taper, and then fastened to the aircraft structure. The problem here lies in the means of fastening. Rivets must be anchored in a substructure situated beneath the skin. The substructure abuts the blind surface of the perforated skin and blocks the perforations. This reduces the area of the perforated exposed surface available to control laminar flow, and thus reduces the efficiency of the perforated skin in controlling laminar flow. Moreover, installing rivets is costly because it is labor intensive.

Adhesives also have been used to fasten the skin to the airplane structure. There are several problems with this approach. The strength of the adhesive blend proportional to the abutting surface area of the two opposing surfaces being fastened to each other. As the blind surface of the perforated skin is fastened to an underlying solid substructure, the perforations are blocked across the area of attachment. The substantial surface area required by an adhesive thus directly reduces the area of the perforated exposed surface having unobstructed perforations and, concomitantly, reduces the efficiency of the perforated skin in controlling laminar flow. Furthermore, the strength of the adhesive weakens when repeatedly exposed to the extreme thermal cycles caused by typical flights.

Aircraft parts of exceptional strength and diverse configuration have been fabricated by superplastically deforming metallic sheets placed in abutment in forming packs. Though obviously desirable, the fabrication of a perforated skin for an airplane by superplastically deforming a perforated metallic sheet has not been achieved. The reason is that superplastic forming relies on the sustained application of a substantial pressure differential between the sheets of the forming pack. This pressure differential is created by the injection of a pressurized forming gas between the sheets. Leakage of the forming gas through the perforations of the sheet that is to form the perforated skin would prevent its superplastic deformation.

SUMMARY OF THE INVENTION

Briefly, a perforated sheet is fabricated by using an electron beam or laser gun to drill evenly spaced perforations of the same shape through a solid metallic sheet. The electron beam or laser gun drills tapered holes of an approximately circular transverse cross section having a maximum diameter at the sheet surface nearest the gun and a smaller diameter at the other surface. The perforated sheet is diffusion bonded to a thinner solid metallic sheet so that the surface of the perforated sheet having the smaller diameter of each perforation abuts the thin sheet. The bonded thin sheet and perforated sheet are included with other solid metallic sheets in a forming pack to be superplastically deformed into a structure.

The bonded perforated sheet and thin sheet are placed on the top of the forming pack so that the thin sheet will face outwards after the structure is formed. After the superplastic deformation process is completed, the thin sheet is removed by machining to expose the surface of the perforated sheet. The exposed surface of the perforated sheet includes the smaller diameter of each tapered perforation, while the inner-facing or blind surface of the sheet includes the maximum diameter.

The formed structure includes internal passageways. The perforated sheet fluidly communicates the ambient atmosphere with the passageways. Control of laminar flow over the exposed surface of the perforated sheet is obtained by controlling the pressure in the passageways.

Since the perforations are drilled through a sheet prior to the fabrication of the structure, the perforations have an exposed diameter that is smaller than the diameter at the blind surface, so that clogging of the perforations by airborne particles is minimized. Moreover, the exposed diameter can be drilled to the small size required to control the laminar flow over airplanes. Furthermore, the invention avoids introducing dust into the internal passageways of the structure.

As the perforated sheet is an integral part of a superplastically formed structure, the attachment of the sheet to the remainder of the structure is demonstrably stronger that the bonding provided by the adhesives of the prior art, and is much less susceptible to the deleterious effect of repeated thermal cycles. In addition, the surface area of the perforated sheet that is obstructed because it is used to attach the perforated sheet to the rest of the structure is significantly less than the attachment area required by the prior art adhesives or rivets. This increases the total surface area of the perforations available to control laminar flow, and thus improves the efficiency of the invented structure over the perforated skins of the prior art.

DESCRIPTION OF AN EMBODIMENT OF THE INVENTION

Figure 1:
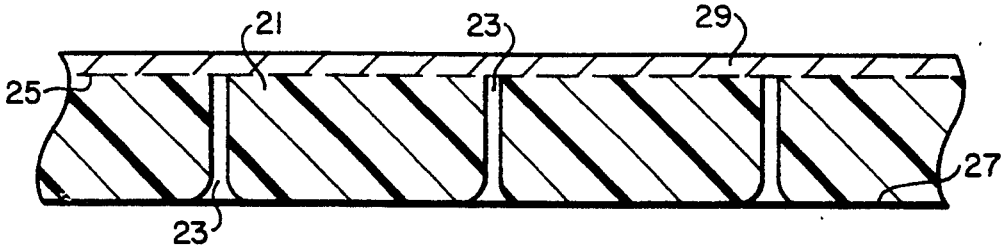
FIG. 1 is a cross-sectional view of a perforated sheet diffusion bonded to a thin solid sheet.

Turning to FIG. 1, perforated sheet 21 is produced by using an electron beam gun or laser gun to drill perforations 23 in a solid sheet of the desired metallic composition. In order to control laminar flow across the surface of an airplane, it is advisable to drill the perforations so that the diameter on surface 25 (ultimately the surface exposed to fluid flow) is less than 0.004 of an inch where the thickness of perforated sheet 21 is 0.040 of an inch.

Perforations 23 have a uniform tapered shape and an approximately circular transverse cross section. A titanium alloy is typically used because the gun can drill perforations of the desired shape and transverse cross section in titanium alloys. More particularly, perforations 23 have a maximum diameter at surface 27, the surface which will ultimately face inwards. Surface 27 is also known as the blind surface. At surface 25, perforations 23 have a diameter smaller than the maximum diameter at surface 27.

Figure 2:
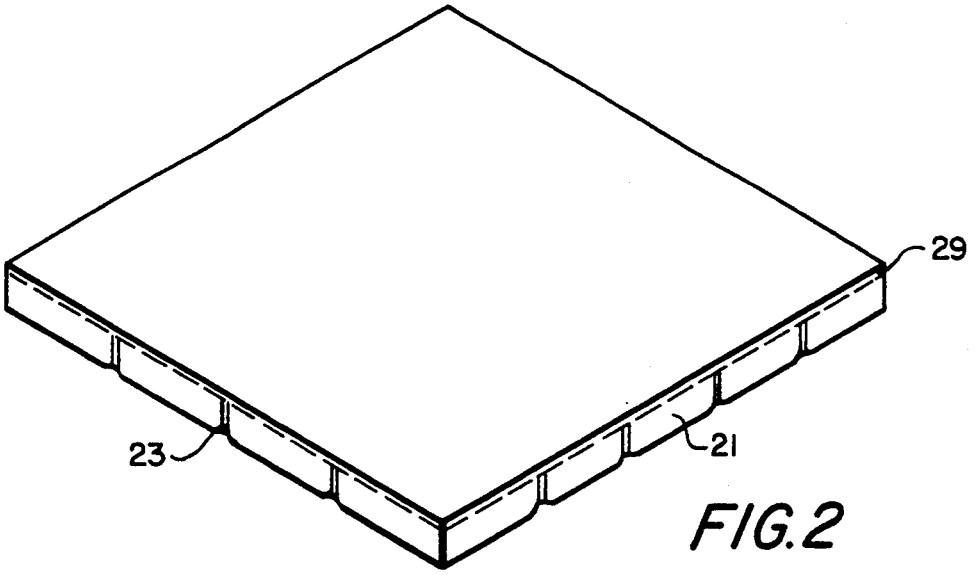
FIG. 2 is perspective view of the two bonded sheets shown in FIG. 1.

As shown in FIGS. 1 and 2, perforated sheet 21 is diffusion bonded to thin solid sheet 29 so that surface 25 abuts thin sheet 29. As diffusion bonding creates an intermingling of the molecules of the two bonded pieces, there is no discernible difference between perforated sheet 21 and thin sheet 29. However, to facilitate understanding of the invention, the foregoing two sheets are delineated with an imaginary dashed line.

Figure 3:
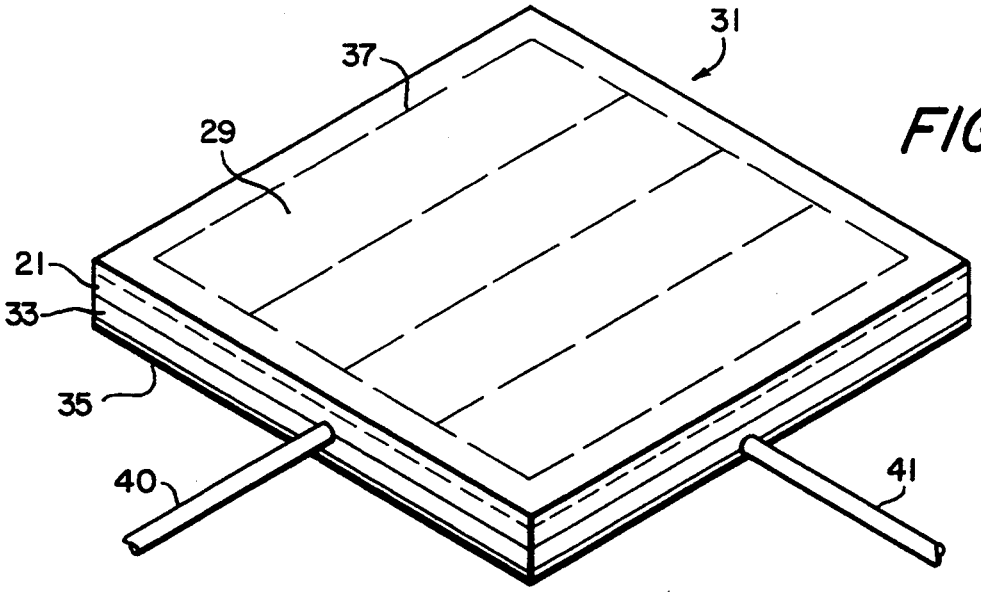
FIG. 3 is a perspective view of a forming pack of metallic sheets that consists of the bonded perforated sheet and thin sheet, a face sheet, and core sheet.

As illustrated by FIG. 3, forming pack 31 is then formed. Forming pack 31 is composed of perforated sheet 21, thin sheet 29, solid core sheet 33, and solid face sheet 35. Perforated sheet 21 is placed in forming pack 31 so that surface 27 abuts core sheet 33. Perforated sheet 21 is attached to core sheet 33 by means of seam welds 37. As will be subsequently shown, the length and location of seam welds 37 determine the location of webs in the finished structure.

Figure 4:
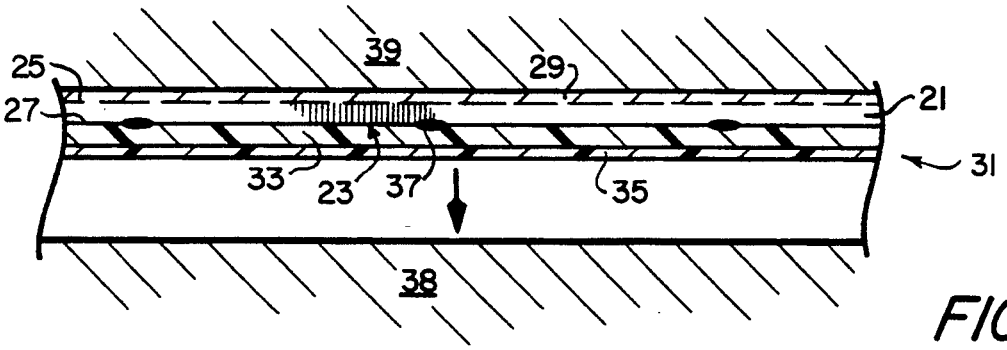
FIG. 4 is a partial cross-sectional view of the forming pack shown in FIG. 3. The forming pack is shown positioned in a forming die, prior to superplastic deformation of the sheets into a structure for laminar flow control.

As shown by FIG. 4, forming pack 31 is placed in a superplastic forming die. Wall 38 located opposite face sheet 35 and wall 39 located opposite thin sheet 29 are the only parts of the forming die shown in the drawings. Gas inlets 40 and 41 are welded to forming pack 31. Gas inlet 40 is positioned so that it can inject pressurized forming gas in between perforated sheet 21 and core sheet 33. Gas inlet 40 is positioned to inject pressurized forming gas in between perforated sheet 21 and core sheet 33. Gas inlet 41 is positioned to inject pressurized forming gas in between core sheet 33 and face sheet 35.

Figure 5:
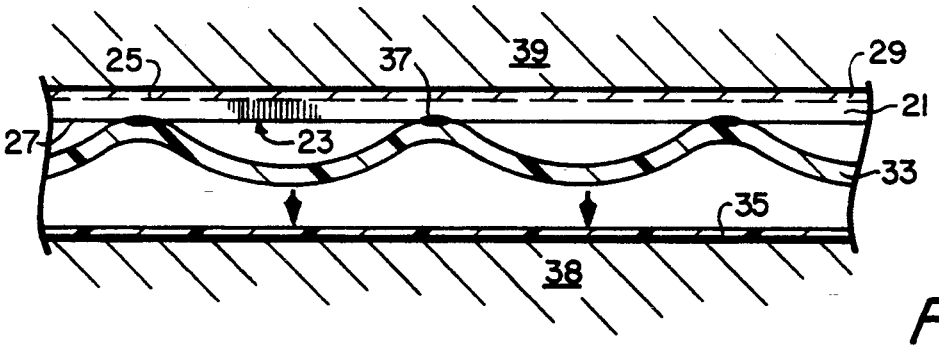
FIG. 5 is a partial cross-sectional view of the forming pack shown in FIGS. 3 and 4 after superplastic deformation of the face sheet has been completed. The core sheet is partially deformed.

Forming pack 31 is then heated to the temperature at which the sheets can be superplastically deformed using methodology well known to those skilled in the art of superplastic forming. As shown by FIG. 5, face sheet 35 first deforms against wall 38 of the forming die in response to the injection of pressurized forming gas in between core sheet 33 and face sheet 35 by means of gas inlet 41. Core sheet 33 is also beginning to deform in response to the injection by means of gas inlet 40 of pressurized forming gas in between core sheet 33 and perforated sheet 21.

Thin sheet 29 abuts wall 39. The pressure in between the abutting surfaces is lower than the high forming pressure in the space in between perforated sheet 21 and core sheet 33. The presence of thin sheet 29 prevents the forming gas in the space in between perforated sheet 21 and core sheet 33 from leaking out through perforations 23 of sheet 21. The prevention of leakage by thin sheet 29 allows superplastic forming of core sheet 33 to proceed in accordance with well-known methodology.

Figure 6:
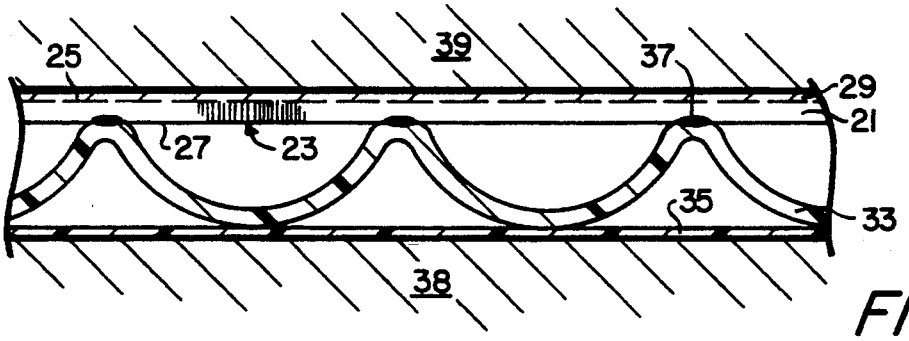
FIG. 6 is a partial cross-sectional view of the forming pack shown in FIGS. 3 and 4 after further deformation of the core sheet to the point where it touches the deformed face sheet at several locations.
Figure 7:
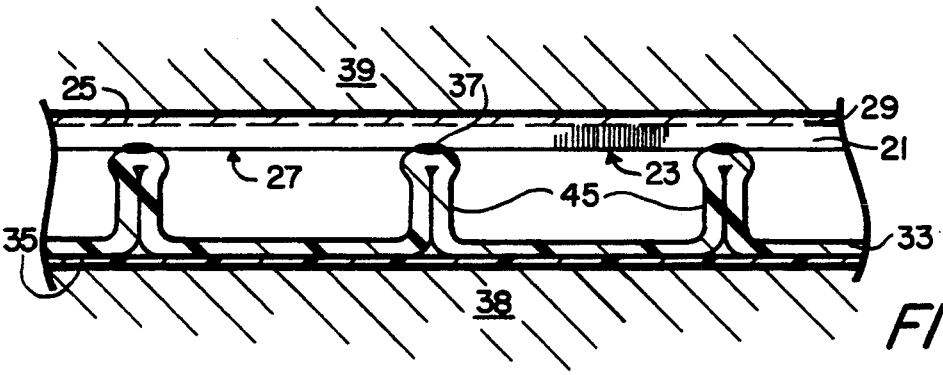
FIG. 7 is a partial cross-sectional view of the forming pack shown in FIGS. 3 and 4 after superplastic deformation of the sheets has been completed.

FIG. 6 shows further deformation of core sheet 33 causing contact between core sheet 33 and face sheet 35. FIG. 7 shows forming pack 31 after the completion of the superplastic deformation. The doubling over of core sheet 33 along seam welds 37 forms webs 45.

Figure 8A:
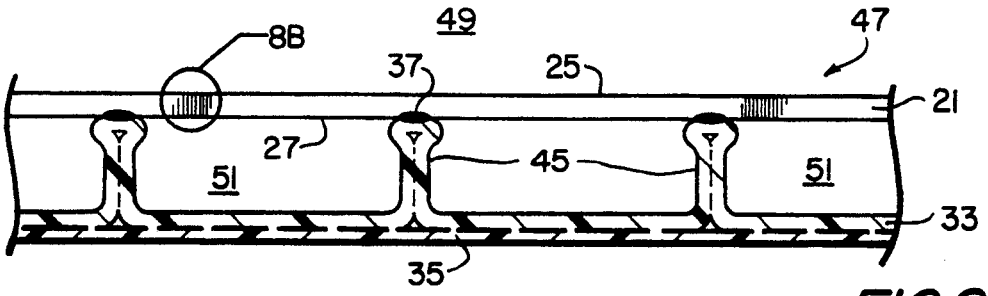
FIG. 8A is a partial cross-sectional view of the superplastically formed structure previously shown in FIG. 7, but with the thin sheet removed to provide the finished structure for laminar flow control

After deformed forming pack 31 is removed from the forming die, laminar flow control structure 47 is produced by removing thin sheet 29 by machining. As shown in FIG. 8A, this leaves surface 25 of perforated sheet 21 exposed to ambient atmosphere 49. Imaginary dashed lines show where core sheet 33 has doubled over and diffusion bonded to form webs 45, and also where core sheet 33 has become diffusion bonded to face sheet 35.

Figure 8B:
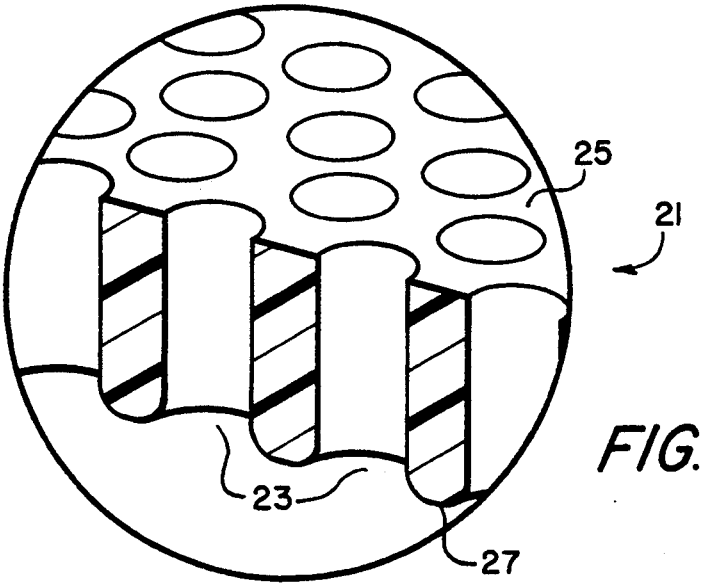
FIG. 8B is an enlargement of a portion of the perforated sheet shown in FIG. 8A, particularly showing the taper of the perforations.
Figure 9:
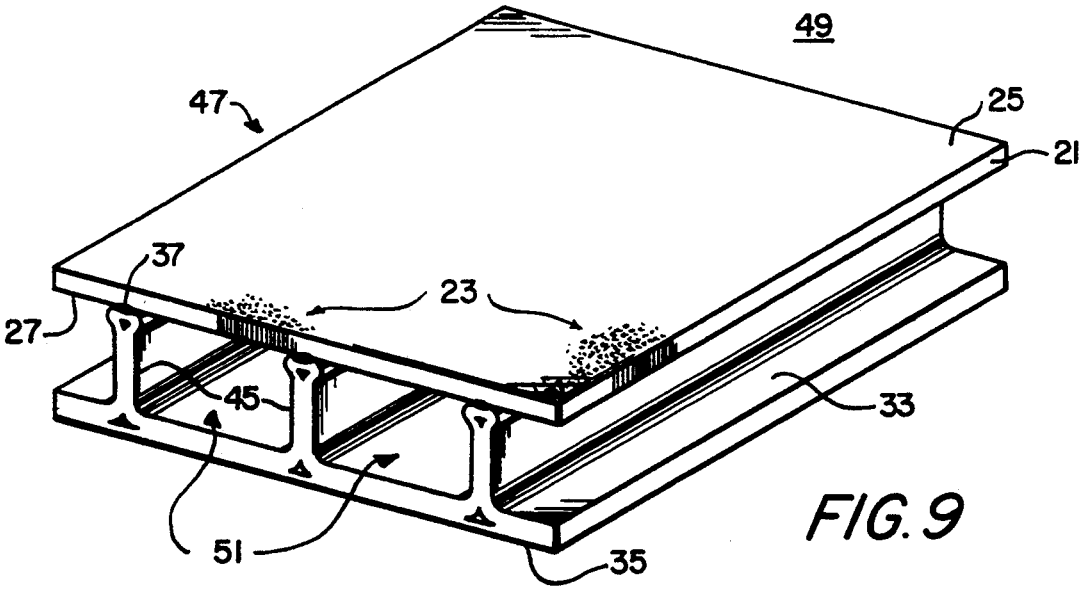
FIG. 9 is a perspective view of the superplastically formed structure for laminar flow control shown in FIG. 8.

FIG. 8B shows an enlargement of a portion of perforated sheet 21 of laminar flow control structure 47. The shape of perforations 23 are shown in detail. More particularly, perforations 23 are tapered to have a maximum diameter at surface 27, the blind surface. A perspective view of laminar flow control structure 47 is provided by FIG. 9.

Passageways 51 are formed by webs 45, the remaining part of core sheet 33, and perforated sheet 21. Ambient atmosphere 49 fluidly communicates with passageways 51 through perforations 23. Laminar flow across surface 25 can be controlled by controlling the pressure in passageways 51. The respective pressures in passageways 51 may vary, so as to compensate for changing flow conditions across surface 25. Passageways 51 are provided only as a simple example of this principle. More complex passageways may be constructed by using processes and forming pack configurations well known to those skilled in the superplastic forming art.

Changes and modifications to the specifically described embodiment may be made without departing from the scope of the invention, as the invention is intended to be limited only by the scope of the appended claims.

What is claimed is:

1. A method of producing a laminar flow control apparatus comprising:

diffusion bonding a perforated sheet to a solid sheet;

fastening a core sheet to said perforated sheet;

forming a forming pack that includes said solid sheet, said perforated sheet and said core sheet;

superplastically deforming said forming pack to produce a first structure; and removing said solid sheet from said first structure.

2. The method of producing a laminar flow control apparatus recited in claim 1 wherein the fastening step is comprised of welding said core sheet to said perforated sheet.

* * * * *